US005766417A

United States Patent [19]

Brungardt

[11] Patent Number: 5,766,417

[45] Date of Patent: Jun. 16, 1998

[54] PROCESS FOR USING ALKALINE SIZED PAPER IN HIGH SPEED CONVERTING OR REPROGRAPHICS OPERATIONS

[75] Inventor: Clement Linus Brungardt, Chester, Pa.

[73] Assignee: Hercules Incorporated, Wilmington, Del.

[21] Appl. No.: 611,730

[22] Filed: Mar. 6, 1996

[51] Int. Cl.[6] ..... D21H 17/17

[52] U.S. Cl. ..... 162/158; 162/164.1; 162/179

[58] Field of Search ..... 162/158, 164.1, 162/179, 164.3, 168.1

[56] References Cited

U.S. PATENT DOCUMENTS

| | | | |
|---|---|---|---|
| 3,311,532 | 3/1967 | Kulick et al. | 162/179 |
| 4,040,900 | 8/1977 | Mazzarella et al. | 162/158 |
| 4,302,283 | 11/1981 | Blitzer et al. | 162/158 |
| 4,576,680 | 3/1986 | Kawatani et al. | 162/158 |
| 4,606,773 | 8/1986 | Novak | 106/213 |
| 4,687,519 | 8/1987 | Trzasko et al. | 106/211 |
| 4,861,376 | 8/1989 | Edwards et al. | 106/123.1 |
| 4,915,786 | 4/1990 | Sweeney | 162/158 |
| 4,964,915 | 10/1990 | Blixt et al. | 106/210 |
| 5,114,538 | 5/1992 | Malatesta | 162/158 |
| 5,176,748 | 1/1993 | Nikoloff et al. | 106/211 |
| 5,407,537 | 4/1995 | Malatesta et al. | 162/158 |
| 5,510,003 | 4/1996 | Colasurdo et al. | 162/158 |

FOREIGN PATENT DOCUMENTS

| | | | |
|---|---|---|---|
| 0 093 321 | 11/1983 | European Pat. Off. | D21H 3/02 |
| 0629741 | 12/1994 | European Pat. Off. | D21H 17/17 |
| 0666368 | 8/1995 | European Pat. Off. | D21H 17/17 |
| 8903906-9 | 6/1990 | Sweden . | |
| 2252984 | 8/1992 | United Kingdom | D21H 21/16 |
| 94/13883 | 6/1994 | WIPO | D21H 21/16 |

OTHER PUBLICATIONS

Hercules Incorporated Product Data No. 7622, "Precis™ 2000 Alkaline Size For Precision–Converting Grades" (Feb. 1994).

Hercules Incorporated Product Data No. 7622–2, "Precis™ 2000 Alkaline Size For Precision–Converting Grades " (Aug. 1996).

Hercules Incorporated Product Data No. 7637, "Precis™ 3000 Alkaline Size For Precision–Converting Grades" (Jul. 1994).

Hercules Incorporated Product Data No. 7637–1, "Precis™ 3000 Alkaline Size For Precision–Converting Grades" (Aug. 1996).

Hercules Incorporated, "Precis™ Alkaline Sizing Agent For Precision Fine Paper Producer" (Feb.1994).

C.L. Brungardt and J.C. Gast, "Alkenyl–Substituted Sizing Agents for Precision Converting Grades of Fine Paper," TAPPI Papermakers' Conference Proceedings (1996).

C.L. Brungardt and J.C. Gast, "Improving the Converting and End–Use Performance of Alkaline Fine Paper," TAPPI Papermakers' Conference Proceedings (1994).

Press Release "Hercules Develops Alkaline Paper Size Designed for Precision Converting Grades," Jan.17, 1994.

TAPPI, *1994 Papermakers Conference Proceedings, Book 1*, 1994, pp. 155–163.

*The Sizing of Paper, Second Edition*, TAPPI Press, 1989, pp. 51–62.

*Primary Examiner*—Donald E. Czaja
*Assistant Examiner*—Jose A. Fortuna
*Attorney, Agent, or Firm*—Martin F. Sloan; Mark D. Kuller

[57] ABSTRACT

A process for using paper in high speed converting or reprographics operations, comprising the steps of providing paper sized under alkaline conditions with alkenyl succinic anhydride (ASA) and 2-oxetanone that is not solid at 35° C., and using the paper in high speed converting or reprographic operations. A process for making paper under alkaline conditions comprising the steps of providing sizing agent comprising alkenyl succinic anhydride (ASA) and 2-oxetanone that is not solid at 35° C., and sizing the paper with the sizing agent.

37 Claims, 2 Drawing Sheets

PROCESS FOR USING ALKALINE SIZED PAPER IN HIGH SPEED CONVERTING OR REPROGRAPHICS OPERATIONS

FIELD OF THE INVENTION

This invention relates to processes for using alkaline sized paper in high speed converting or reprographic operations.

BACKGROUND OF THE INVENTION

The amount of fine paper produced under alkaline conditions has been increasing rapidly, encouraged by cost savings, the ability to use precipitated calcium carbonate, an increased demand for improved paper permanence and brightness, and an increased tendency to close the wet end of the paper machine.

Many current applications for fine paper require particular attention to sizing before conversion or end-use. Examples are high-speed photocopies, envelopes, forms bond including computer printer paper, and adding machine paper. The most common sizing agents for fine paper made under alkaline conditions are alkenyl succinic anhydride (ASA) and alkyl ketene dimer (AKD). Both types have reactive functional groups that are believed to covalently bond to cellulose fiber, and hydrophobic tails that are oriented away from the fiber. The nature and orientation of these hydrophobic tails cause the fiber to repel water.

Commercial AKD's, containing one β-lactone ring (also known as 2-oxetanone ring), are prepared by the dimerization of the alkyl ketenes made from two saturated, straight-chain fatty acid chlorides, the most widely used being prepared from palmitic and/or stearic acid. Other ketene dimers, such as the alkenyl-based ketene dimer (Aquapel® 421, available from Hercules Incorporated, Wilmington, Del., U.S.A.), have also been used commercially.

Commercial ASA-based sizing agents are prepared by the reaction of maleic anhydride with olefins containing from about 14 to about 22 carbon atoms.

Although ASA and AKD sizing agents are commercially successful, they have disadvantages. On the paper machine, ASA frequently causes deposits that can result in paper web breaks and holes in the paper. ASA addition levels above 2.0–2.5 lb/ton of paper generally lead to unacceptable paper machine runnability, and paper quality problems. However, addition levels greater than 2.0–2.5 lb/ton often are required to size paper grades made with high levels of filler. Finally, because ASA cannot be shipped and stored in emulsion form for long periods of time, the papermaker must prepare the emulsion immediately before use.

For AKD-based sizes, the most frequently cited shortcoming is the rate of size development on the paper machine. Often, an extended period of curing is required before sizing development is complete.

Both types of sizing agent, particularly the AKD type, have been associated with handling problems in the typical high-speed conversion operations required for the current uses of fine paper made under alkaline conditions (referred to as alkaline fine paper). The problems include reduced operating speed in forms presses and other converting machines, double feeds or jams in high-speed copiers, and registration errors on printing and envelope-folding equipment that operate at high speeds. Recently, 2-oxetanone sizing agents that are not solid at 35° C. have been introduced (e.g., Precis® 2000 sizing agent available from Hercules Incorporated, Wilmington, Del.) to address the problem of handling problems in high-speed conversion operations.

One such handling problem in high-speed conversion operations has been identified and measured as described in "Improving the Converting and End Use Performance of Alkaline Fine Paper," *TAPPI* 1994 *Paper Makers Conference Proceedings, Book* 1 (1994), pages 155–163, the disclosure of which is incorporated herein by reference. The problem occurs when using an IBM 3800 high speed continuous forms laser printer that does not have special modifications intended to facilitate handling of alkaline fine paper. This commercially significant laser printer, therefore, can serve as an effective testing device for defining the convertibility of various types of sized paper on state-of-the-art converting equipment and its subsequent end-use performance. In particular, the phenomenon of "billowing" gives a measurable indication of the extent of slippage on the IBM 3800 printer between the undriven roll beyond the fuser and the driven roll above the stacker.

Such billowing involves a divergence of the paper path from the straight line between the rolls, which is two inches (5 cm) above the base plate, causing registration errors and dropped folds in the stacker. The rate of billowing during steady-state running time is measured as the billowing height in inches above the straight paper path after 600 seconds of running time and multiplied by 10,000.

Typical alkaline AKD sized fine paper at size addition levels higher than 2.2 lbs. per ton (1 kg per 0.9 metric ton) of paper often shows an unacceptable rate-of-billowing, typically of the order of 20 to 80. Paper handling rates on other high-speed converting machinery, such as the Hamilton-Stevens continuous forms press, or the Winkler & Dunnebier CH envelope folder also provide numerical measures of convertibility.

U.S. patent application Ser. No. 08/254,813, filed Jun. 6, 1994 and European Patent Application No. 0 629 741 A1, both of which are incorporated herein by reference, disclose paper sized with 2-oxetanone sizing agent that is a mixture of alkyl ketene dimer and 2-oxetanone multimers of various molecular weights. The paper exhibits levels of sizing comparable to those obtained with current alkyl ketene dimer and alkenyl succinic anhydride sizes, and gives improved performance in high speed converting and reprographic machines.

U.S. patent application Ser. No.08/192,570, filed Feb. 7, 1994, and European Patent Application No. 0 666 368 A, both of which are incorporated herein by reference, disclose paper that is sized with 2-oxetanone sizing agent and that does not encounter machine feed problems in high speed converting or reprographic machines. The 2-oxetanone sizing agent is liquid below 35° C. and is prepared from fatty acids having structural irregularities in their hydrocarbon chains such as carbon-carbon double bonds and chain branching.

U.S. patent application Ser. No. 08/428,288, filed Apr. 25, 1995, which is incorporated herein by reference, discloses 2-oxetanone sizing agents that are not solid at 35° C. and made from fatty acids containing at least about 25% linoleic acid. Paper sized with the sizing agents does not encounter machine feed problems in high speed converting or reprographic machines.

U.S. patent application Ser. No. 08/439,057, filed May 8, 1995, which is incorporated herein by reference, discloses sizing compositions for fine paper that does not encounter machine feed problems in high-speed converting. The sizing compositions are not solid at 35° C. and comprise a mixture of 2-oxetanone compounds that are the reaction product of a mixture of saturated and unsaturated fatty acids.

U.S. Pat. No. 5,407,537 teaches a method for using synthetic reactive sizing compounds which eliminates the use of an emulsifier and reduces hydrolysis of the sizing compound during its residence period in the process water. The preferred synthetic reactive sizing compounds are alkenyl succinic anhydrides where the alkenyl group has 8–16 carbon atoms. The possibility of using mixtures of alkenyl succinic anhydrides and alkyl ketene dimers is disclosed.

U.K. Patent Application GB 2,252,984 A discloses a sizing composition that is a blend of from 3 to 50 wt.% alkyl ketene dimer and 97 to 50 wt.% alkyl or alkenyl cyclic acid anhydride.

Swedish Patent Application No. 893,906 discloses packaging board for fluid sized with combinations of alkyl ketene dimer and alkenyl succinic anhydride.

The alkyl ketene dimers disclosed in U.S. Pat. No. 5,407,537, U.K. Patent Application GB 2,252,984 A and Swedish Patent Application No. 893,906 are solid alkyl ketene dimers.

There is a need for alkaline fine paper that provides improved handling performance in typical converting and reprographic operations. At the same time, the levels of sizing development must be comparable to that obtained with the current furnish levels of 2-oxetanone or ASA for alkaline fine paper.

SUMMARY OF THE INVENTION

This invention relates to a process for using paper in high speed converting or reprographics operations, comprising the steps of providing paper sized under alkaline conditions with alkenyl succinic anhydride (ASA) and 2-oxetanone that is not solid at 35° C., and using the paper in high speed converting or reprographic operations. Preferably, the 2-oxetanone sizing agent comprises at least one 2-oxetanone compound that is the reaction product of a reaction mixture comprising unsaturated monocarboxylic fatty acid, where the term "fatty acid" is used for convenience to mean a fatty acid or fatty acid halide.

In another embodiment, the invention relates to a process for making paper under alkaline conditions comprising the steps of providing sizing agent comprising alkenyl succinic anhydride (ASA) and 2-oxetanone that is not solid at 35° C., and sizing the paper with the sizing agent.

DETAILED DESCRIPTION OF THE INVENTION

Figure 1:
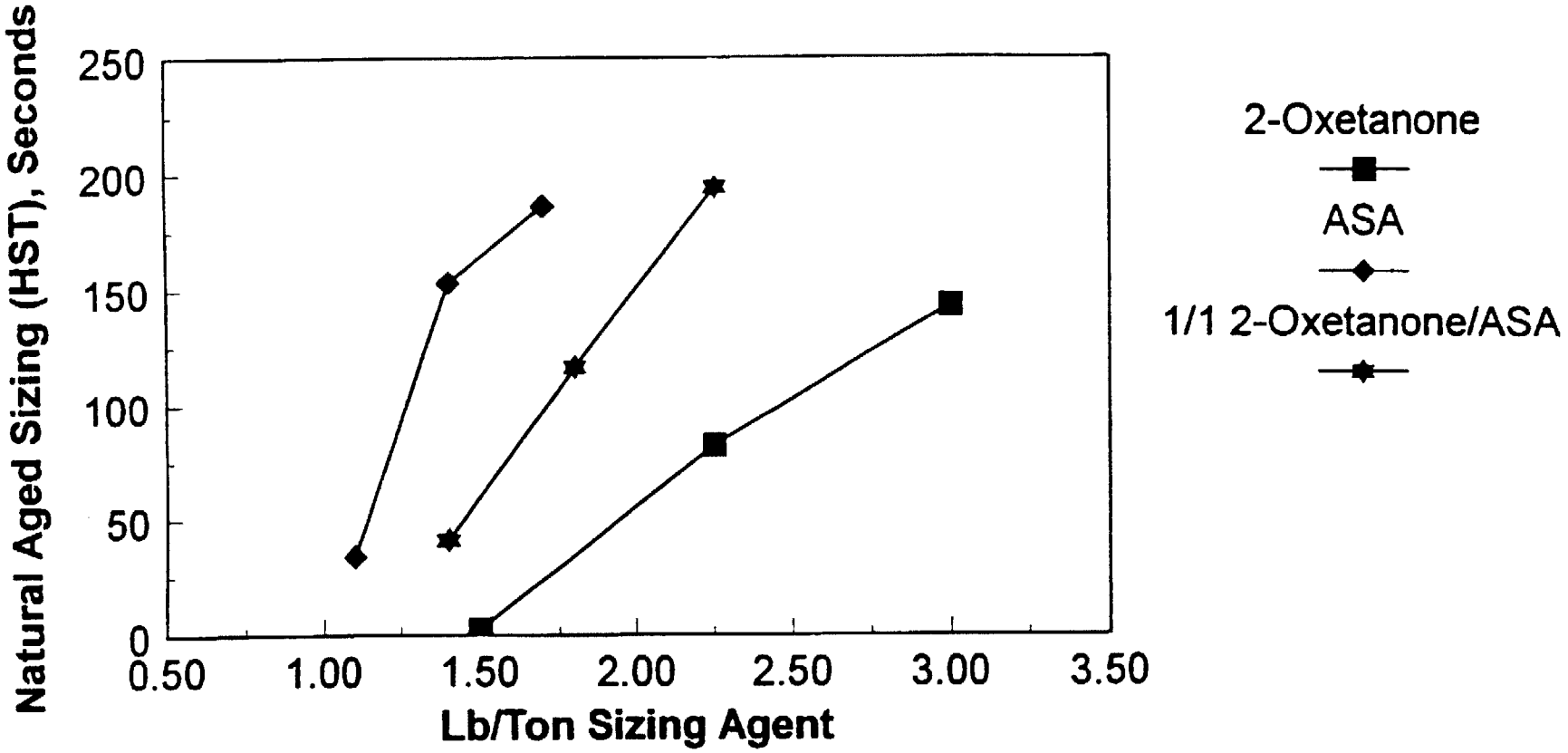
FIGS. 1 and 2 are graphs of the level of natural aged sizing obtained at several addition levels with a) 2-oxetanone that is not solid at 35° C., b) alkenyl succinic anhydride (ASA) and c) blends of ASA and 2-oxetanone that is not solid at 35° C.

Hereinafter, the term "fatty acid" will be used for convenience to mean a fatty acid or fatty acid halide. The person of ordinary skill in the art will recognize that this term is used herein when referring to fatty acids for use in making sizing compositions, since fatty acids are converted to acid halides, preferably chlorides, in the first step of making 2-oxetanone compounds, and that the invention may be practiced by starting with fatty acids or with fatty acids already converted to their acid halide. Further, the person of ordinary skill in the art will readily recognize that "fatty acid" generally refers either to pure fatty acids or fatty acid halides, or to a blend or mixture of fatty acids or fatty acid halides since fatty acids are generally derived from natural sources and thus are normally blends or mixtures.

The 2-oxetanones of this invention are disclosed in U.S. patent application Ser. No. 08/192,570, filed Feb. 7, 1994 and U.S. patent application Ser. No. 08/428,288, filed Apr. 25, 1995, both of which are incorporated herein by reference in their entireties. The 2-oxetanones, which may be a blend of 2-oxetanones, are not solid at 35° C. (not substantially crystalline, semicrystalline or waxy solids, i.e., they flow on heating without heat of fusion). Preferably, the 2-oxetanones are not solid at 25° C., and more preferably not solid even at 20° C. Even more preferably, the 2-oxetanones are liquid at 35° C., more preferably liquid at 25° C., and most preferably liquid at 20° C.

The 2-oxetanones in accordance with this invention are a mixture of compounds of the following general class:

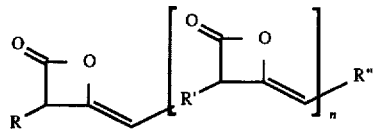

in which n is preferably 0 to 6, more preferably 0 to 3, and most preferably 0; R and R", which can be the same or different, are saturated or unsaturated, straight chain or branched alkyl groups having 8 to 24 carbon atoms; R' is a saturated or unsaturated, straight chain or branched alkyl group having 2 to 40 carbon atoms, preferably 4 to 32 carbon atoms; and wherein at least 25% of the R and R" groups in the mixture of compounds is unsaturated.

The 2-oxetanones may comprise a mixture of 2-oxetanone compounds that are the reaction product of a reaction mixture comprising unsaturated monocarboxylic fatty acids. The reaction mixture may further comprise saturated monocarboxylic fatty acids and dicarboxylic acids.

Preferably the reaction mixture for preparing the mixture of 2-oxetanone compounds comprises at least 25 wt % unsaturated monocarboxylic fatty acids, and more preferably at least 70 wt % unsaturated monocarboxylic fatty acids.

The unsaturated monocarboxylic fatty acids included in the reaction mixture for preparation of 2-oxetanone compounds preferably have 10–26 carbon atoms, more preferably 14–22 carbon atoms, and most preferably 16–18 carbon atoms. These acids include, for example, oleic, linoleic, dodecenoic, tetradecenoic (myristoleic), hexadecenoic (palmitoleic), octadecadienoic (linolelaidic), octadecatrienoic (linolenic), eicosenoic (gadoleic), eicosatetraenoic (arachidonic), cis-13-docosenoic (erucic), trans-13-docosenoic (brassidic), and docosapentaenoic (clupanodonic) acids, and their acid halides, preferably chlorides. One or more of the monocarboxylic acids may be used. Preferred unsaturated monocarboxylic fatty acids are oleic, linoleic, linolenic and palmitoleic acids, and their acid halides. Most preferred unsaturated monocarboxylic fatty acids are oleic and linoleic acids, and their acid halides.

The saturated monocarboxylic fatty acids used to prepare the 2-oxetanone compounds used in this invention preferably have 10–26 carbon atoms, more preferably 14–22 carbon atoms, and most preferably 16–18 carbon atoms. These acids include, for example, stearic, isostearic, myristic, palmitic, margaric, pentadecanoic, decanoic, undecanoic, dodecanoic, tridecanoic, nonadecanoic, arachidic and behenic acids, and their halides, preferably chlorides. One or more of the saturated monocarboxylic fatty acids may be used. Preferred acids are palmitic and stearic.

The alkyl dicarboxylic acids used to prepare the 2-oxetanone compounds for use in this invention preferably have 6–44 carbon atoms, and more preferably 9–10, 22 or 36 carbon atoms. Such dicarboxylic acids include, for example, sebacic, azelaic, 1,10-dodecanedioic, suberic, brazylic, docosanedioic acids, and $C_{36}$ dimer acids, e.g. EMPOL 1008 available from Henkel-Emery, Cincinnati, Ohio, U.S.A, and their halides, preferably chlorides. One or more of these dicarboxylic acids can be used. Dicarboxylic acids with 9–10 carbon atoms are more preferred. The most preferred dicarboxylic acids are sebacic and azelaic acids.

When dicarboxylic acids are used in the preparation of the 2-oxetanones for use in this invention, the maximum mole ratio of dicarboxylic acid to monocarboxylic acid (the sum of both saturated and unsaturated) is preferably about 5. A more preferred maximum is about 4, and the most preferred maximum is about 2.

The mixture of 2-oxetanone compounds may be prepared using methods known for the preparation of standard ketene dimers. In the first step, acid halides, preferably, acid chlorides, are formed from a mixture of fatty acids, or a mixture of fatty acids and dicarboxylic acid, using $PCl_3$ or another halogenating, preferably chlorinating, agent. The acid halides are then converted to ketenes in the presence of tertiary amines (including trialkyl amines and cyclic alkyl amines), preferably triethylamine. The ketene moieties then dimerize to form the 2-oxetanones.

The alkenyl succinic anhydrides (ASA) used for blending with 2-oxetanones in this invention are described by C. E. Farley and R. B. Wasser in "The Sizing of Paper, Second Edition", edited by W. F. Reynolds, Tappi Press, 1989, pages 51–62, which is incorporated herein by reference. ASA's are composed of unsaturated hydrocarbon chains containing pendant succinic anhydride groups. Liquid ASA's, which are preferred in the processes of this invention, are usually made in a two-step process starting with an alpha olefin. The olefin is first isomerized by randomly moving the double bond from the alpha position. In the second step the isomerized olefin is reacted with an excess of maleic anhydride to give the final ASA structure as indicated in the following reaction scheme.

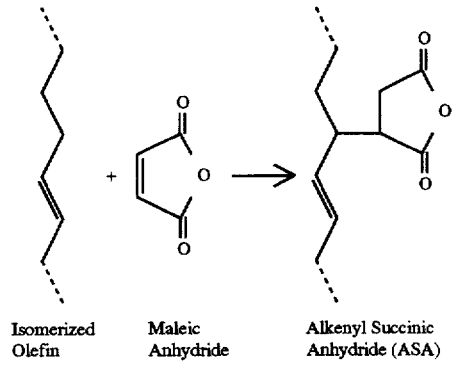

If the isomerization step is omitted, ASA's that are solid at room temperature may be produced.

The starting alpha olefin is preferably in the C-14 to C-22 range and may be linear or branched. For the purpose of this invention, it is more preferred that the ASA's be prepared by reaction of maleic anhydride with olefins containing 14–18 carbon atoms. Typical structures found in ASA's are disclosed in U.S. Pat. No. 4,040,900, which is incorporated herein by reference in its entirety.

A variety of ASA's are commercially available from Albemarle Corporation, Baton Rouge, La.

Representative starting olefins for reaction with maleic anhydride to prepare ASA's for use in this invention include: octadecene, tetradecene, hexadecene, eicodecene, 2-n-hexyl-1-octene, 2-n-octyl-1-dodecene, 2-n-octyl-1-decene, 2-n-dodecyl-1-octene, 2-n-octyl-1-octene, 2-n-octyl-1-nonene, 2-n-hexyl-1-decene and 2-n-heptyl-1-octene.

In the blends of ASA and 2-oxetanone, the maximum weight ratio of 2-oxetanone to ASA is preferably about 9:1. More preferably the maximum is about 4:1, and most preferably about 2:1. The minimum ratio of 2-oxetanone to ASA is preferably about 1:9. More preferably the minimum is about 1:4, and most preferably about 1:2.

Generally the sizes of this invention are utilized in the form of dispersions or emulsions, which can be prepared by methods well known in the art. It is preferred that the sizes be utilized as internal sizing agents, i.e., added to the paper pulp slurry before sheet formation. The ASA and 2-oxetanone sizing components may be preblended before addition, or added separately.

The paper of this invention is preferably sized at a total size (i.e., ASA plus 2-oxetanone) addition rate of at least 0.5 lb (0.2 kg), more preferably at least about 1.5 lb (0.8 kg), and most preferably at least about 2.2 lb/ton (1 kg/0.9 metric tons) or higher. It may be, for example, in the form of continuous forms bond paper, perforated continuous forms paper, adding machine paper, or envelope-making paper, as well as converted products, such as copy paper and envelopes.

Preferably the alkaline paper made according to the process of this invention contains a water soluble inorganic salt of an alkali metal, preferably sodium chloride (NaCl). However, the paper of this invention will often be made without NaCl as well.

There are several advantages to the process of this invention for using paper in high speed converting or reprographics operations as compared to the process where the paper is sized with either ASA alone or 2-oxetanone that is not solid at 35° C. alone. First, at moderate to low size addition levels, the paper of this invention has a higher level of natural aged sizing (sizing after aging for 7 days at room temperature) than does paper sized with an equivalent amount of 2-oxetanone that is not solid at 35° C. Second, the paper is produced with a lower level of paper machine deposits than paper produced at equal levels of sizing using ASA size. Third, better on-machine sizing is obtained with ASA and 2-oxetanone that is not solid at 35° C. than is obtained when using 2-oxetanone that is not solid at 35° C. alone. This is often important for runnability on the paper machine.

Furthermore, the process of this invention is also an improvement over the process where the paper is sized utilizing ASA and solid alkyl ketene dimers. When solid alkyl ketene dimer is used, special equipment must be employed to melt the alkyl ketene dimer in order to prepare aqueous dispersions. This melting step is not necessary for use of liquid 2-oxetanone.

The paper of this invention does not encounter significant machine-feed problems on high speed converting machines or in reprographic operations. In particular, the paper according to this invention can be made into a roll of continuous forms bond paper having a basis weight of about 15 to 24 lb/1300 $ft^2$ (6.8 to 10.9 kg/121 $m^2$) and that is sized at an addition rate of at least about 1.5 lb/ton (0.68 kg/0.9 metric ton), and that is then capable of running on the IBM Model 3800 high speed, continuous-forms laser printer with no significant machine feed problems.

Further, the preferred paper, according to the invention, that can be made into sheets of 8½×11 inch (21.6 cm ×28 cm) reprographic cut paper having a basis weight of about 15–24 lb/1300 $ft^2$ (6.8 to 10.9 kg/121 $m^2$), is capable of running on a high speed laser printer or copier. When the paper is sized at a total size (i.e., ASA plus 2-oxetanone) addition rate that is preferably at least about 1.5 lb/ton (0.68 kg/0.9 metric ton), and more preferably at least about 2.2 lb/ton (1 kg/0.9 metric ton), it is capable of running on the IBM model 3825 high-speed copier without causing misfeeds or jams at a rate of more than 5 in 10,000 sheets, preferably at a rate of no more than 1 in 10,000 sheets. By comparison, paper sized with standard AKD has a much higher rate of double feeds on the IBM 3825 high speed copier (14 double feeds in 14,250 sheets). In conventional copy-machine operation, 10 double feeds in 10,000 is unacceptable. A machine manufacturer considers 1 double feed in 10,000 sheets to be unacceptable.

The paper of this invention in the form of a roll of continuous forms bond paper having a basis weight of about 15–24 lb/1300 $ft^2$ (6.8 to 10.9 kg/121 $m^2$) can be converted to a standard perforated continuous form on a continuous forms press at a press speed of about 1300 to 2000 feet (390 m to 600 m) per minute or more. The preferred paper according to the invention, in the form of a roll of continuous forms bond paper having a basis weight of about 15–24 lb/1300 $ft^2$ (6.8 to 10.9 kg/121 $m^2$), and that is sized at an addition rate of at least about 2.2 lb/ton (1 kg per 0.9 metric ton) can be converted to a standard perforated continuous form on the Hamilton-Stevens continuous forms press at a press speed of at least about 1775 feet (541 m) per minute, preferably at least about 1900 feet (579 m) per minute.

The paper of this invention can also be made into a roll of envelope paper having a basis weight of about 15–24 lb/1300 $ft^2$ (6.8 to 10.9 kg/121 $m^2$) that is sized at an addition rate of at least about 2.2 lb/ton (1 kg/0.9 metric ton). The paper can be converted into at least about 900 envelopes per minute, preferably at least about 1000 per minute on a Winkler & Dunnebier CH envelope folder.

The paper of this invention can be run at a speed of at least about 58 sheets per minute on a high speed sheet-fed copier (IBM 3825) with less than 1 in 10,000 double feeds or jams.

The paper of this invention is capable of running on a high speed, continuous-forms laser printer with a rate of billowing at least about 10% less, preferably about 20% less, than that produced when running on the same printer, a roll of continuous forms bond paper having the same basis weight and sized at the same level with an AKD size made from a mixture of stearic and palmitic acids, after 10 minutes of running time.

The paper of this invention is capable of running on a high speed sheet-fed copier (IBM 3825) at a speed of about 58 sheets per minute with at least about 50% fewer, preferably about 70% fewer, double feeds or jams than the number of double feeds or jams caused when running on the same copier, sheets of paper having the same basis weight and sized at the same level with an AKD size made from a mixture of stearic and palmitic acids.

The paper of this invention is also capable of being converted to a standard perforated continuous form on a continuous forms press at a press speed at least 3% higher, preferably at least 5% higher, than paper having the same basis weight and sized at the same level with an AKD size made from a mixture of stearic and palmitic acids.

EXPERIMENTAL PROCEDURES

All parts, percentages, etc. herein are by weight unless otherwise specified.

Paper for evaluation on the IBM 3800 was prepared on a pilot paper machine. To make a typical forms bond papermaking stock, the pulp furnish (three parts Southern hardwood kraft pulp and one part Southern softwood kraft pulp) was refined to 425 ml Canadian Standard Freeness (C.S.F.) using a double disk refiner. Prior to the addition of the filler to the pulp furnish (10% medium particle-size precipitated calcium carbonate), the pH, alkalinity and hardness of the papermaking stock were adjusted using the appropriate amounts of $H_2SO_4$, $NaHCO_3$, NaOH, and $CaCl_2$, to pH 7.8–8.0, alkalinity 150–200 ppm, and hardness 100 ppm.

The 2-oxetanone compounds were prepared by methods used conventionally to prepare commercial 2-oxetanone compounds i.e., acid chlorides from a mixture of fatty acids are formed using a conventional chlorination agent, and then the acid chlorides are dehydrochlorinated in the presence of a suitable base. ASA was Alkenylsuccinic Anhydride C16C18, obtained from Albemarle Corp., Baton Rouge, La.

Emulsions of the ASA/2-oxetanone blends were prepared immediately before use by methods described by C. E. Farley & R. B. Wasser, in "The Sizing of Paper (Second Edition)", edited by W. F. Reynolds, Tappi Press, 1989, pages 51–62, which is incorporated herein by reference in its entirety. The emulsions were prepared using Stalok 400 cationic starch (available from A.E. Staley Manufacturing Co., Decatur Ill.) at a level of 3:1 starch to sizing agent.

Wet-end additions of sizing agent, quaternary-amine-substituted cationic starch (0.75% for Example 3, and 0.5% for Examples 1 and 2), alum (0.2%), and retention aid (0.025%) were made. Stock temperature at the headbox and white water tray was controlled at 110° F. (43.3° C.).

The wet presses were set at 40 psi(2.8 kg/$cm^2$) gauge. A dryer profile that gave 1–2% moisture at the size press and 4–6% moisture at the reel was used (77 feet (23.4 m) per minute). Approximately 35 lb/ton (15.9 kg/0.9 metric ton) of an oxidized corn starch, Stayco C (A. E. Staley Manufacturing Co., Decatur Ill.), and 1 lb/ton (0.45 kg/0.9 metric ton) of NaCl were added at the size press (130° F. (54.4° C.), pH 8). Calender pressure and reel moisture were adjusted to obtain a Sheffield smoothness of 150 flow units at the reel (Column #2, felt side up).

A 35-minute roll of paper was collected and converted on a commercial forms press to two boxes of standard 8½"×11" (21.6×28 cm) forms. Samples were also collected before and after each 35 minute roll for testing natural aged sizing and basis weight (46 lb/3000 $ft^2$, 20.8 kg/279 $m^2$), and smoothness testing.

The converted paper was allowed to equilibrate in the printer room for at least one day prior to evaluation. Each box of paper allowed a 10–14 minute (220 feet (66.7 m) per minute) evaluation on the IBM 3800. All samples were tested in duplicate. A standard acid fine paper was run for at least two minutes between each evaluation to reestablish initial machine conditions.

In order to establish whether a sizing agent contributed to difficulties in converting operations, paper was made on a pilot paper machine, converted into forms, and then printed on an IBM 3800 high speed printer. The runnability on the IBM 3800 was used as a measure of converting performance. Specifically, the height in inches to which the paper billowed between two defined rolls on the IBM 3800 and the rate at which billowing occurred was used to quantify converting performance. The faster and higher the sheet billowed, the worse the converting performance.

The Hercules Size Test (HST) is a standard test in the industry for measuring the degree of sizing. This method employs an aqueous dye solution as the penetrant to permit optical detection of the liquid front as it moves through the sheet. The apparatus determines the time required for the reflectance of the sheet surface not in contact with the penetrant to drop to a predetermined percentage of its original reflectance. All HST testing data reported measure the seconds to 80% reflection with 1% formic acid ink mixed with naphthol green B dye unless otherwise noted. The use of formic acid ink is a more severe test than neutral ink and tends to give faster test times. High HST values are better than low values.

EXAMPLE 1

In this example a 1:1 blend of 2-oxetanone and alkenyl succinic anhydride was evaluated for sizing efficiency at several addition levels. For comparison, samples of 2-oxetanone and ASA alone were run under the same conditions.

The 2-oxetanone was prepared by the usual procedures using Emersol-221 as the feedstock. Emersol-221, available from Henkel-Emery, Cincinnati, Ohio, had the following composition:

| | |
|---|---|
| oleic acid | 73% |
| linoleic acid | 8 |
| palmitoleic acid | 6 |
| myristoleic acid | 3 |
| linolenic acid | 1 |
| saturated fatty acids | 9. |

The ASA was Alkenylsuccinic Anhydride C16C18, obtained from Albemarle Corp., Baton Rouge, La.

The evaluation data are in Table 1 and presented graphically in FIG. 1. The data indicate that the natural-aged sizing for the ASA/2-oxetanone blends is less than that of ASA alone but greater than that for 2-oxetanone alone at equivalent size addition levels.

TABLE 1

| Experiment | Sizing Agent | Size Addition Level, Lb/Ton of Dry Paper | Natural Aged Sizing, (HST) Seconds |
|---|---|---|---|
| 1A (comparative) | 2-Oxetanone | 1.5 | 2 |
| 1B (comparative) | 2-Oxetanone | 2.25 | 82 |
| 1C (comparative) | 2-Oxetanone | 3.0 | 143 |
| 1D (comparative) | ASA | 1.1 | 34 |
| 1E (comparative) | ASA | 1.4 | 153 |
| 1F (comparative) | ASA | 1.7 | 186 |
| 1G | 1:1 2-oxetanone/ASA | 1.4 | 41 |
| 1H | 1:1 2-oxetanone/ASA | 1.8 | 116 |
| 1I | 1:1 2-oxetanone/ASA | 2.25 | 194 |

EXAMPLE 2

In this example blends of 2-oxetanone and alkenyl succinic anhydride at two ratios were evaluated for sizing efficiency at several addition levels. For comparison, samples of 2-oxetanone sizing agent alone and ASA alone were run under the same conditions.

The 2-oxetanone and ASA were the same as those used in Example 1.

Figure 2:
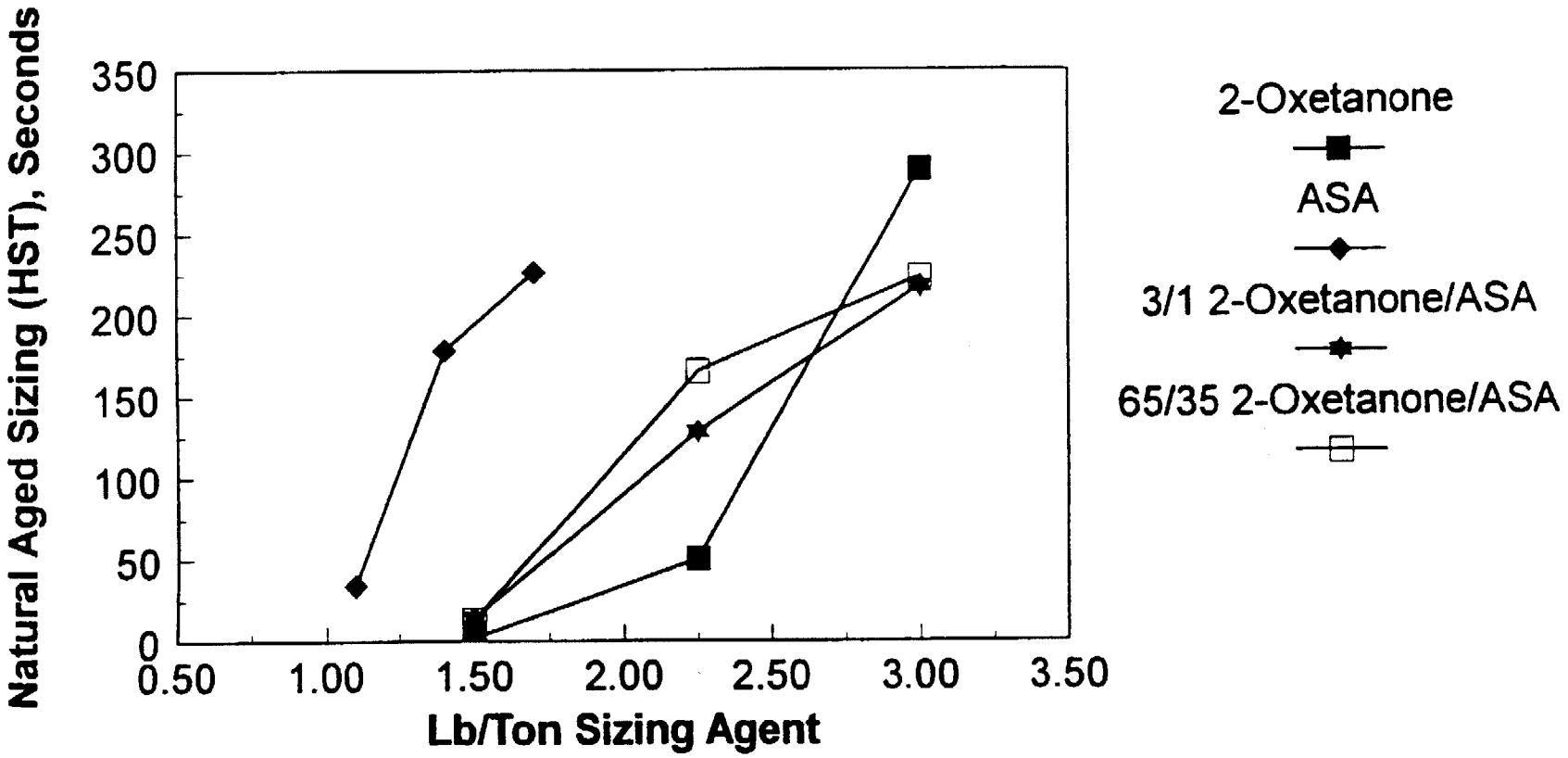

The results are in Table 2 and presented graphically in FIG. 2. The data demonstrate that at the 2-oxetanone/ASA ratios of 3:1 and 65:35 the natural aged sizing is less than that of ASA alone but greater than that with 2-oxetanone alone below about 2.75 lb/ton addition level.

TABLE 2

| Experiment | Sizing Agent | Size Addition Level, Lb/Ton of Dry Paper | Natural Aged Sizing, (HST) Seconds |
|---|---|---|---|
| 2A (comparative) | 2-Oxetanone | 1.5 | 2 |
| 2B (comparative) | 2-Oxetanone | 2.25 | 50 |
| 2C (comparative) | 2-Oxetanone | 3.0 | 289 |
| 2D (comparative) | ASA | 1.1 | 34 |
| 2E (comparative) | ASA | 1.4 | 178 |
| 2F (comparative) | ASA | 1.7 | 226 |
| 2G | 3:1 2-oxetanone/ASA | 1.5 | 14 |
| 2H | 3:1 2-oxetanone/ASA | 2.25 | 128 |
| 2I | 3:1 2-oxetanone/ASA | 3.0 | 217 |
| 2J | 65:35 2-oxetanone/ASA | 1.5 | 13 |
| 2K | 65:35 2-oxetanone/ASA | 2.25 | 165 |
| 2L | 65:35 2-oxetanone/ASA | 3.0 | 223 |

EXAMPLE 3

In this example blends of 2-oxetanone and ASA at 3 ratios were tested for their effects on the runnability of a difficult to convert grade of alkaline fine paper on the IBM 3800. A comparative experiment, 3A, utilizes Hercon® 70 sizing agent, a dispersion containing alkyl ketene dimer prepared from a mixture of palmitic and stearic acids, available from Hercules Incorporated, Wilmington, Del. The materials utilized in the remainder of the experiments were as described in Example 1.

The evaluation data are in Table 3. The data show that the 2-oxetanone/ASA blends at all 3 ratios tested produced paper that ran on the IBM 3800 with good to very good runnability. Moreover, at the 3.0 lb/ton addition level all three ratios tested produced paper that ran on the IBM 3800 with runnability better than that of paper made with Hercon® 70.

TABLE 3

| Experiment | Sizing Agent | Size Addition Level, Lb/Ton of Dry Paper | IBM 3800 Converting Performance* |
|---|---|---|---|
| 3A (comparative) | Hercon ®70 | 3.0 | 2.5 |
| 3B | 1:1 2-oxetanone/ASA | 3.0 | 2 |
| 3C | 1:3 2-oxetanone/ASA | 3.0 | 1.5 |
| 3D | 3:1 2-oxetanone/ASA | 3.0 | 1 |

*IBM Runnability
1 - Very Good (Billowing rate $\times 10^4 < 2.1$ in/sec))
2 - Good (Billowing rate $\times 10^4 = 2.1$–$6.2$ in/sec)
3 - Poor (Billowing rate $\times 10^4 = 6.2$–$16.7$ in/sec)
4 - Very Poor (Billowing rate $\times 10^4 = > 16.7$ in/sec)

It is not intended that the examples given here should be construed to limit the invention, but rather they are submitted to illustrate some of the specific embodiments of the invention. various modifications and variations of the present invention can be made without departing from the scope of the appended claims.

What is claimed is:

1. A process for using paper in high speed converting or reprographics operations, comprising the steps of providing paper sized under alkaline conditions with alkenyl succinic anhydride (ASA) and 2-oxetanone that is not solid at 35° C., wherein the ration of 2-oxetanone to ASA is not greater than about 9:1, and using the paper in high speed converting or reprographic operations.

2. The process of claim 1, wherein the 2-oxetanone is not solid at 25° C.

3. The process of claim 1, wherein the 2-oxetanone is not solid at 20° C.

4. The process of claim 1, wherein the 2-oxetanone is liquid at 35° C.

5. The process of claim 1, wherein the 2-oxetanone is liquid at 25° C.

6. The process of claim 1, wherein the 2-oxetanone is liquid at 20° C.

7. The process of claim 1, wherein the ASA is the reaction product of maleic anhydride and an olefin having 14–18 carbon atoms.

8. The process of claim 1, wherein the ASA is the reaction product of maleic anhydride with olefins selected from the group consisting of octadecene, tetradecene, hexadecene, eicodecene, 2-n-hexyl-1-octene, 2-n-octyl-1-dodecene, 2-n-octyl-1-decene, 2-n-dodecyl-1-octene, 2-n-octyl-1-octene, 2-n-octyl-1-nonene, 2-n-hexyl-1-decene and 2-n-heptyl-1-octene.

9. The process of claim 1, wherein the ratio of 2-oxetanone to ASA is no greater than about 4:1.

10. The process of claim 1, wherein the ratio of 2-oxetanone to ASA is no greater than about 2:1.

11. The process of claim 1, wherein the ratio of 2-oxetanone to ASA is no less than about 1:9.

12. The process of claim 1, wherein the ratio of 2-oxetanone to ASA is no less than about 1:4.

13. The process of claim 1, wherein the ratio of 2-oxetanone to ASA is no less than about 1:2.

14. The process of claim 1, wherein the 2-oxetanone comprises at least one 2-oxetanone compound that is the reaction product of a reaction mixture comprising unsaturated monocarboxylic fatty acids and tertiary aminos.

15. The process of claim 14, wherein the unsaturated monocarboxylic fatty acids comprises one or more fatty acids selected from the group consisting of oleic, linoleic, dodecenoic, tetradecenoic (myristoleic), hexadecenoic (palmitoleic), octadecadienoic (linolelaidic), octadecatrienoic (linolenic), eicosenoic (gadoleic), eicosatetraenoic (arachidonic), cis-13-docosenoic (erucic), trans-13-docosenoic (brassidic), and docosapentaenoic (clupanodonic) acids, and their acid halides.

16. The process of claim 14, wherein the unsaturated monocarboxylic fatty acids comprises one or more fatty acids selected from the group consisting of oleic, linoleic, linolenic and palmitoleic acids, and their acid halides.

17. The process of claim 14, wherein the reaction mixture comprises at least 25% oleic acid, or its acid halide, by weight.

18. The process of claim 14, wherein the reaction mixture comprises at least 70% oleic acid, or its acid halide, by weight.

19. The process of claim 14, wherein the reaction mixture comprises at least 25% linoleic acid, or its acid halide, by weight.

20. The process of claim 14, wherein the reaction mixture comprises at least 70% linoleic acid, or its acid halide, by weight.

21. The process of claim 14, wherein the ASA is the reaction product of maleic anhydride and an olefin having 14–18 carbon atoms, and the ratio of 2-oxetanone to ASA is from about 4:1 to about 1:4.

22. The process of claim 14, wherein the reaction mixture comprises at least 25% unsaturated monocarboxylic fatty acids by weight.

23. The process of claim 22, wherein the ASA is the reaction product of maleic anhydride and an olefin having 14–18 carbon atoms, and the ratio of 2-oxetanone to ASA is from about 4:1 to about 1:4.

24. The process of claim 14, wherein the reaction mixture further comprises saturated monocarboxylic fatty acids.

25. The process of claim 24, wherein the reaction mixture comprises at least 25% unsaturated monocarboxylic fatty acids by weight.

26. The process of claim 24, wherein the reaction mixture comprises at least 70% unsaturated monocarboxylic fatty acids by weight.

27. The process of claim 24, wherein the saturated monocarboxylic fatty acid comprises one or more fatty acids selected from the group consisting of stearic, isostearic, myristic, palmitic, margaric, pentadecanoic, decanoic, undecanoic, dodecanoic, tridecanoic, nonadecanoic, arachidic and behenic acids, and their acid halides.

28. The process of claim 24, wherein the saturated monocarboxylic fatty acids comprises palmitic or stearic acid, or their acid halides.

29. The process of claim 14, wherein the reaction mixture comprises at least 70% unsaturated monocarboxylic fatty acids by weight.

30. The process of claim 29, wherein the dicarboxylic acid comprises dicarboxylic acids containing 8–36 carbon atoms.

31. The process of claim 29 wherein the ASA is the reaction product of maleic anhydride and an olefin having 14–18 carbon atoms, and the ratio of 2-oxetanone to ASA is from about 4:1 to about 1:4.

32. The process of claim 14, wherein the reaction mixture further comprises dicarboxylic acid, or its acid halide.

33. The process of claim 32, wherein the dicarboxylic acid comprises dicarboxylic acids containing 6–44 carbon atoms.

34. The process of claim 32, wherein the dicarboxylic acid is selected from the group consisting of 9–10 carbon, 22 carbon and 36 carbon dicarboxylic acid.

35. The process of claim 32, wherein the dicarboxylic acid is azelaic acid.

36. The process of claim 32, wherein the dicarboxylic acid is sebacic acid.

37. A process for making paper under alkaline conditions comprising the steps of:

a) providing an aqueous pulp slurry;

b) adding to the aqueous slurry sizing agent comprisg alkenyl succinic anhydride (ASA) and 2-oxetanone that is not solid at 35° C.; wherein the ration of 2-oxetanone to ASA is not greater than about 9:1 and c) sheeting and drying the pulp slurry obtained in step (b) to obtain paper.

* * * * *

UNITED STATES PATENT AND TRADEMARK OFFICE

CERTIFICATE OF CORRECTION

PATENT NO. : 5,766,417

DATED : JUNE 16, 1998

INVENTOR(S) : Clement L. Brungardt

It is certified that error appears in the above-identified patent and that said Letters Patent is hereby corrected as shown below:

Column 11, Claim 14, line 46 , "tertiary aminos" should read --tertiary amines--.

Column 12, Claim 37, line 58, "comprisg" should read --comprising--.

Signed and Sealed this

Second Day of February, 1999

*Attest:*

*Acting Commissioner of Patents and Trademarks*

*Attesting Officer*